US009371648B1

(12) United States Patent
Tikhovskiy

(10) Patent No.: US 9,371,648 B1
(45) Date of Patent: Jun. 21, 2016

(54) CONCRETE BUILDING STRUCTURE AND METHOD FOR MODULAR CONSTRUCTION OF SAME

(71) Applicant: Nikolay P. Tikhovskiy, Richmond Hill (CA)

(72) Inventor: Nikolay P. Tikhovskiy, Richmond Hill (CA)

( * ) Notice: Subject to any disclaimer, the term of this patent is extended or adjusted under 35 U.S.C. 154(b) by 0 days.

(21) Appl. No.: 14/842,948

(22) Filed: Sep. 2, 2015

(51) Int. Cl.

| | |
|---|---|
| ***E04B 5/16*** | (2006.01) |
| ***E04B 5/18*** | (2006.01) |
| ***E04B 1/16*** | (2006.01) |
| ***E04B 5/04*** | (2006.01) |

(52) U.S. Cl.
CPC . *E04B 5/18* (2013.01); *E04B 1/165* (2013.01); *E04B 5/04* (2013.01); *E04B 5/046* (2013.01); *E04B 2103/02* (2013.01)

(58) Field of Classification Search
CPC ..... E04B 1/165; E04B 5/04; E04B 5/18; E04B 5/046; E04B 2103/02
USPC ..... 52/79.1, 236.3, 250, 251, 252, 259, 52/649.1, 649.2
See application file for complete search history.

(56) References Cited

U.S. PATENT DOCUMENTS 938,458 A * 11/1909 Brockhausen ..... E04B 5/43 256/19
1,046,117 A * 12/1912 Skinner ..... E04B 5/40 52/250
1,380,324 A * 5/1921 Piggins ..... E04B 1/215 52/236.7
1,496,819 A * 6/1924 Mitchell ..... B28B 23/18 264/269
3,423,891 A * 1/1969 Burris ..... E04B 1/20 52/15
3,464,176 A * 9/1969 Clements ..... E04B 5/43 52/251
3,613,325 A * 10/1971 Yee ..... E04B 1/20 52/236.8
3,867,805 A * 2/1975 Mikami ..... E04B 1/215 52/252
3,903,667 A * 9/1975 Zetlin ..... E04B 5/48 52/220.3
4,081,935 A * 4/1978 Wise ..... E04B 5/43 52/236.8
4,095,380 A 6/1978 Dillon
4,328,651 A * 5/1982 Gutierrez ..... E02D 27/02 52/169.9
4,409,764 A * 10/1983 Wilnau ..... E04B 1/165 52/127.3
4,550,536 A 11/1985 Lamoure
4,669,240 A 6/1987 Amormino
4,945,695 A * 8/1990 Majurinen ..... E04B 1/16 52/220.3
5,630,300 A 5/1997 Chen (Continued)

*Primary Examiner* — James Buckle, Jr.
(74) *Attorney, Agent, or Firm* — Warner Norcross & Judd LLP

(57) ABSTRACT

A concrete building structure and method for constructing a building structure which includes a first cross-brace section, including a plurality of pre-cast concrete blocks connected in series by at least one rebar; a second cross-brace section, including a plurality of pre-cast concrete blocks connected in series by at least one rebar, extending generally perpendicularly to the first cross-brace section such that the first and second cross-brace sections form a grid understructure; a plurality of channels encapsulating adjacent blocks from the first and second cross-brace sections, whereby the grid understructure includes channels into which concrete may be poured at a building site; each of the plurality of blocks positioned within respective channels; a plurality of pre-cast concrete slabs resting atop the blocks in the grid understructure; and poured concrete filling each of the channels and a space between adjacent concrete slabs to complete a generally flat floor of the building structure.

17 Claims, 9 Drawing Sheets

(56) References Cited

U.S. PATENT DOCUMENTS 5,675,950 A * 10/1997 Schilham ..... E04F 15/02452 52/220.1
5,809,712 A * 9/1998 Simanjuntak ..... E04C 5/08 52/223.7
6,256,960 B1 7/2001 Babcock et al.
6,293,063 B2 * 9/2001 Van Doren ..... E04B 1/20 52/250
6,698,150 B1 3/2004 DiLorenzo
6,920,728 B2 * 7/2005 Powers ..... E04B 1/22 52/236.5
RE39,097 E * 5/2006 Schilham ..... E04F 15/02452 52/220.1
7,124,545 B1 10/2006 Poma et al.
7,185,467 B2 3/2007 Marty
8,291,675 B2 * 10/2012 Tikhovskiy ..... E04B 5/28 52/236.8
8,336,276 B2 12/2012 Tikhovskiy
2001/0003234 A1 * 6/2001 Van Doren ..... E04B 1/165 52/251
2007/0193213 A1 8/2007 Nanayakkara
2008/0263978 A1 * 10/2008 Abou-Saleh ..... E04C 5/06 52/260
2012/0110928 A1 * 5/2012 Liberman ..... E04B 1/34823 52/122.1
2012/0233945 A1 * 9/2012 Rubel ..... E04B 1/24 52/236.3

* cited by examiner

CONCRETE BUILDING STRUCTURE AND METHOD FOR MODULAR CONSTRUCTION OF SAME

FIELD OF THE INVENTION

The embodiments of the invention relate to modularly constructed concrete buildings, and more particularly to a modularly constructed concrete building structure having one or more levels with floors formed from a plurality of precast concrete slabs attached to a grid support base.

BACKGROUND OF THE INVENTION

The construction of buildings formed of poured-in-place concrete and with exterior walls of concrete panels, has been in use for many years. Conventional techniques involve the use of, in general, first of all pouring concrete columns, internally reinforced with rebars, then erecting horizontal form work for pouring a floor slab, and then pouring an entire floor of concrete in situ on the form work at the building site. Usually the construction proceeds by pouring further columns and then pouring floors in situ, to reach the appropriate height of the building. Exterior walls are often erected of precast concrete panels.

Such systems are labor intensive, slow, and expensive. The systems are also wasteful of materials such as form work, and wasteful of concrete and rebars. The form work is usually custom made on site and erected on a large number of internal portable posts. The form work must be laid out and supported accurately so that the pouring of the floor can proceed. The resulting floors are poured in one piece in the majority of cases. Rebars are incorporated throughout such a floor, and the floor is connected to the upper ends of the vertical frames, usually by connecting rebars. The volumes of concrete used in such a system are very considerable. The thickness and weight of the rebars is also considerable. The total weight per floor of the building is therefore made up of relatively massive monolithic slabs of concrete, and large volumes and lengths of heavy rebars. This is wasteful in terms of costs and materials. It also restricts the height of the building since the footings must be designed to carry a certain weight of construction materials when the building is erected and also the occupants of the building and all their equipment.

In addition to all this, the onsite labor costs are considerable. Typically, onsite labor rates will be two or three times the hourly rate paid to employees in the factory. Clearly it is suitable to both reduce the volume of concrete material required and to reduce the weight of the rebars. It is further suitable to reduce the amount of form work which must be erected to support the floors while they are being poured, and cured. It is also suitable to reduce, as far as possible, the onsite labor costs.

It is therefore suitable to manufacture, as far as possible, precast concrete floor components in a factory remote from the building site, and transport such precast floor components to the site and erect them in position. It is also suitable to precast other components including the wall panels, and also the vertical building support columns themselves, and transport them to the site. This will greatly reduce the costs of onsite labor and avoid time spent on erecting formwork, pouring concrete on site, curing time, and removing formwork. It will reduce the time taken to pour concrete on site.

One modular system is disclosed in Russian patent No. 2376424 to Nikolay P. Tikhovskiy. The system disclosed in this patent involves a floor made with the use of pre-cast flat solid concrete slabs, with rebar components extending out from the slabs. The slabs are then supported at floor level, leaving channel spaces between them. In this system, the on-site pouring time and volume of on-site concrete required, and the form-work required is greatly reduced, compared with pouring an entire floor. However, the floor slabs with rebars were still relatively massive.

In another method and system, disclosed in U.S. Pat. No. 8,336,276 issued Dec. 25, 2012 to Nikolay P. Tikhovskiy, the plain flat slabs are replaced with modular precast concrete caissons. The caissons are formed with massive, deep side walls, and a central slab portion of reduced thickness, supported by the side walls. These caissons may be formed in various shapes, typically square or rectangular but may be hexagonal, or even circular or other shapes, to suit the design of the building. The precast caissons are then supported in place at the building site, with their side walls spaced apart being supported by removable posts such as are well known in the art. Between the caisson side walls, channel spaces are defined, which are closed off by form work. Rebars are laid in the channel spaces between the caissons. Concrete beams are then poured on site in the channel spaces between the caissons. The concrete bonds with the side walls of the caissons, thereby forming concrete beams that interconnect and support the caissons. The caissons and the beams thus form a homogenous floor. Such caissons have features capable of interlocking directly with the poured concrete of the beams without the need for interlocking rebars.

The casting of such caissons with relatively complex sidewall features which permit the interlocking is costly, and leads to less flexibility in the design and shape of the perimeter of building floors. Furthermore, the underlying structure and form work required to support the caissons during installation can be cumbersome to create. It would be beneficial to use pre-cast flat concrete slabs as in the Russian patent mentioned above, but to alleviate one or more of the disadvantages described. For example, the ability to use smaller pre-cast flat concrete slabs would be preferred. It would furthermore be beneficial to provide greater support and a strengthened floor surface when compared to the system of the '276 Patent.

SUMMARY OF THE INVENTION

In one embodiment, there is disclosed a concrete building structure including a first cross-brace section, including a plurality of equidistant, pre-cast concrete blocks connected in series by at least one rebar, extending generally the length of a floor in the building structure; a second cross-brace section, including a plurality of equidistant, pre-cast concrete blocks connected in series by at least one rebar, extending generally perpendicularly to the first cross-brace section and spanning a width of the floor in the building structure, such that the first cross-brace section and the second cross-brace section form a grid understructure; a plurality of channels encapsulating adjacent blocks from the first cross-brace section and the second cross-brace section within each element in the grid understructure, whereby the grid understructure includes channels running along its entire length and width into which concrete may be poured at a building site; each of the plurality of blocks positioned within respective channels; a plurality of pre-cast concrete slabs resting atop the blocks in the grid understructure; the pre-cast concrete slabs spaced apart from each other such that concrete may be poured between adjacent concrete slabs; and, poured concrete filling within each of the channels and the space between adjacent concrete slabs to complete a generally flat floor of the building structure.

In one aspect of this embodiment, one or both of the first and the second cross-brace sections further includes a top rebar extending along the length of a top surface thereof.

In another aspect of this embodiment, the top rebar is attached to a top surface of each of the blocks within the first and/or second cross-brace section.

In another aspect of this embodiment, each of the pre-cast concrete slabs include at least one main body rebar extending through the concrete slab and extending outwardly from opposite sides of the concrete slab in a direction parallel to a top surface of the slab.

In another aspect of this embodiment, each of the pre-cast concrete slabs further includes at least one corner rebar extending outwardly from a side of the concrete slab, proximate a corner of the slab; wherein the at least one corner rebar extends outwardly in a direction parallel to the top surface of the slab and then downwardly in a direction perpendicular to the top surface of the slab.

In another aspect of this embodiment, the at least one corner rebar hooks around the top rebar.

In another aspect of this embodiment, the channels comprise panels attached to sides of adjacent blocks from each of the first and second cross-brace sections; and a bottom panel attached to the bottom of each of the blocks.

In another aspect of this embodiment, the blocks further comprise one or more rivets extending upwardly away from a top surface of the blocks; and wherein the pre-cast concrete slabs comprise locating holes corresponding with the one or more rivets.

The concrete building structure may include two or more floors, each floor having the grid understructure, the channels and the plurality of pre-cast concrete slabs as herein described.

In another embodiment, there is provided a method for constructing a concrete building structure including arranging a plurality of supports in a grid-like arrangement; the supports generally defining the ceiling height in a floor of the building structure; placing a plurality of first cross-brace sections on the supports; the first cross-brace sections including a plurality of equidistant, pre-cast concrete blocks connected in series by at least one rebar; wherein one support is provided for each concrete block such that each concrete block rests on its respective support; placing a plurality of second cross-brace sections perpendicular to the first cross-brace sections such that the first and second cross-brace sections form a grid understructure spanning a floor of the concrete structure; the second cross-brace sections including a plurality of equidistant, pre-cast concrete blocks connected in series by at least one rebar; forming a plurality of channels encapsulating adjacent blocks from the first cross-brace section and the second cross-brace section within each element in the grid understructure such that the grid understructure includes channels running along its entire length and width; positioning a plurality of pre-cast concrete slabs atop the blocks in the grid understructure; the pre-cast concrete slabs spaced apart from each other such that concrete may be poured between adjacent concrete slabs; pouring concrete into each of the channels and into the space between adjacent concrete slabs to complete a generally flat floor of the building structure.

In one aspect of this embodiment, one or both of the first and the second cross-brace sections further includes a top rebar extending along the length of a top surface thereof.

In another aspect of this embodiment, the top rebar is attached to a top surface of each of the blocks within the first and/or second cross-brace section.

In another aspect of this embodiment, each of the pre-cast concrete slabs include at least one main body rebar extending through the concrete slab and extending outwardly from opposite sides of the concrete slab in a direction parallel to a top surface of the slab.

In another aspect of this embodiment, each of the pre-cast concrete slabs further includes at least one corner rebar extending outwardly from a side of the concrete slab, proximate a corner of the slab; wherein the at least one corner rebar extends outwardly in a direction parallel to the top surface of the slab and then downwardly in a direction perpendicular to the top surface of the slab.

In another aspect of this embodiment, the at least one corner rebar hooks around the top rebar.

In another aspect of this embodiment, the channels comprise panels attached to sides of adjacent blocks from each of the first and second cross-brace sections; and a bottom panel attached to the bottom of each of the blocks.

In another aspect of this embodiment, the blocks further comprise one or more rivets extending upwardly away from a top surface of the blocks; and wherein the pre-cast concrete slabs comprise locating holes corresponding with the one or more rivets.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE EMBODIMENTS

Generally, the structure and method as herein described permits for a substantial portion of the building structure to be pre-cast or otherwise manufactured offsite and prior to beginning construction on a particular building. In addition, the nature of the pre-cast or otherwise pre-constructed elements allows for a variety of building shapes and designs to be produced using standardized and optionally off-the-shelf elements.

The figures illustrate a sequence of steps in the method for assembling the building, and the various required and/or optional elements will be described in additional detail as they are introduced into the description of the assembly.

Figure 1:
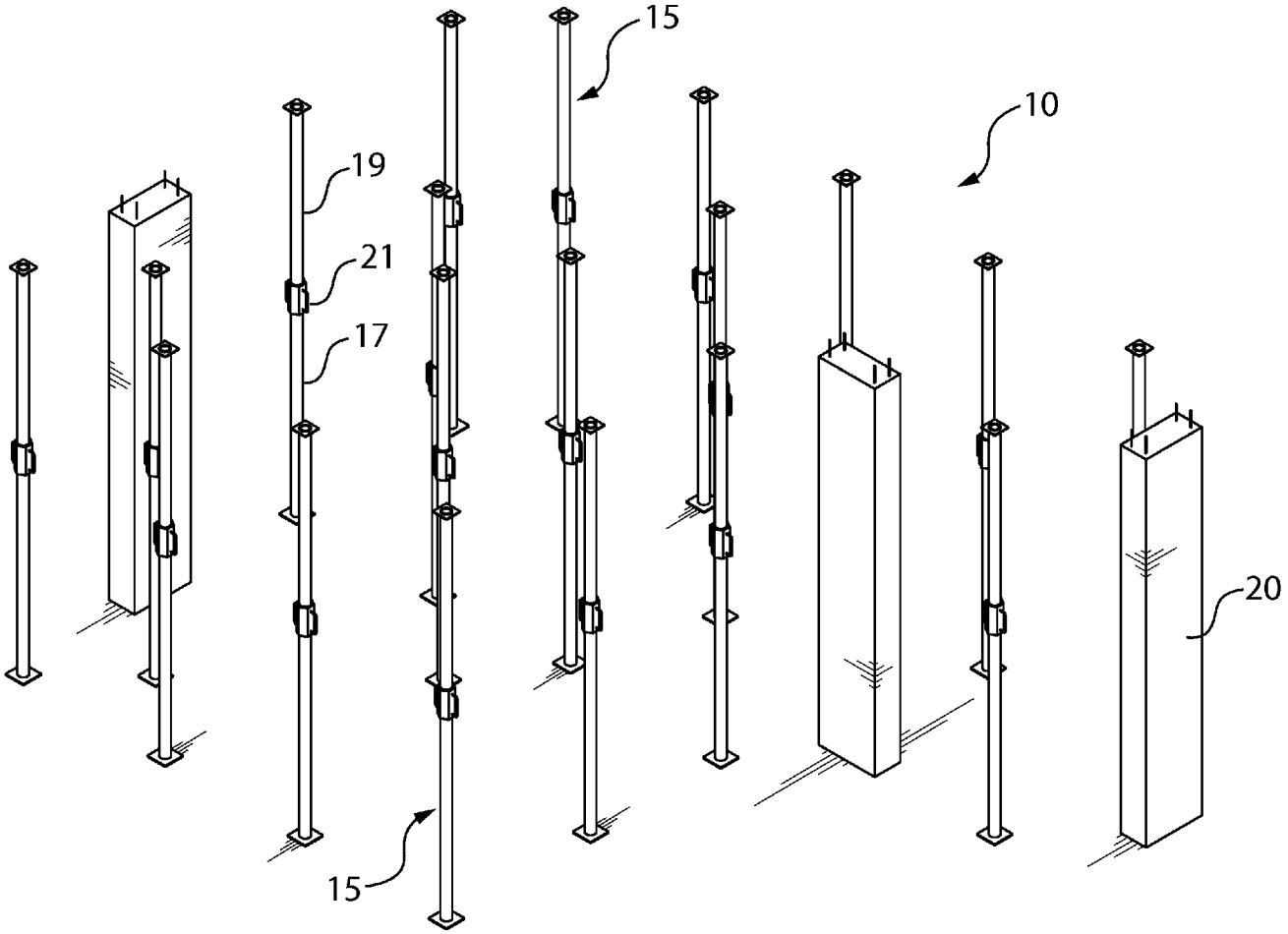
FIG. 1 shows an arrangement of temporary supports upon which a building structure is constructed.

Referring now to FIG. 1, there is shown a site 10 at which a building structure is to be built. Prior to beginning construction, a plurality of supports 15 are laid out, optionally in a grid-like pattern spanning the intended floor area above which a building floor will be created. In practice, a floor such as a foundation or a basement floor will already have been laid, upon which the supports 15 initially rest. It is also possible that a ground floor has already been laid and the supports 15 rest on the ground floor. At various positions around the perimeter or interior to the grid-like arrangement of supports 15, a plurality of pre-cast concrete wall sections 20 may be positioned. These sections 20 can function as load-bearing columns which support the floor being built. In addition, these sections 20 may also later facilitate the connection of the exterior or interior walls of the building structure.

The supports 15 optionally consist of a pair of tubular pipes 17, 19, one of which has an outer diameter smaller than the internal diameter of the other tubular pipe. A clamping or locking mechanism 21 is provided proximate a midsection of the support 15. This arrangement allows the supports 15 to be height-adjustable to a desired ceiling height for a particular floor in the building structure. Alternate supports may be provided by other arrangements. In particular, prior art scaffolding arrangements or other temporary structures upon which a floor could be built are contemplated. Once the floor above has been built, the supports 15 are removed. The number of supports 15, their general design, layout and strength can be determined based on the application.

Figure 2:
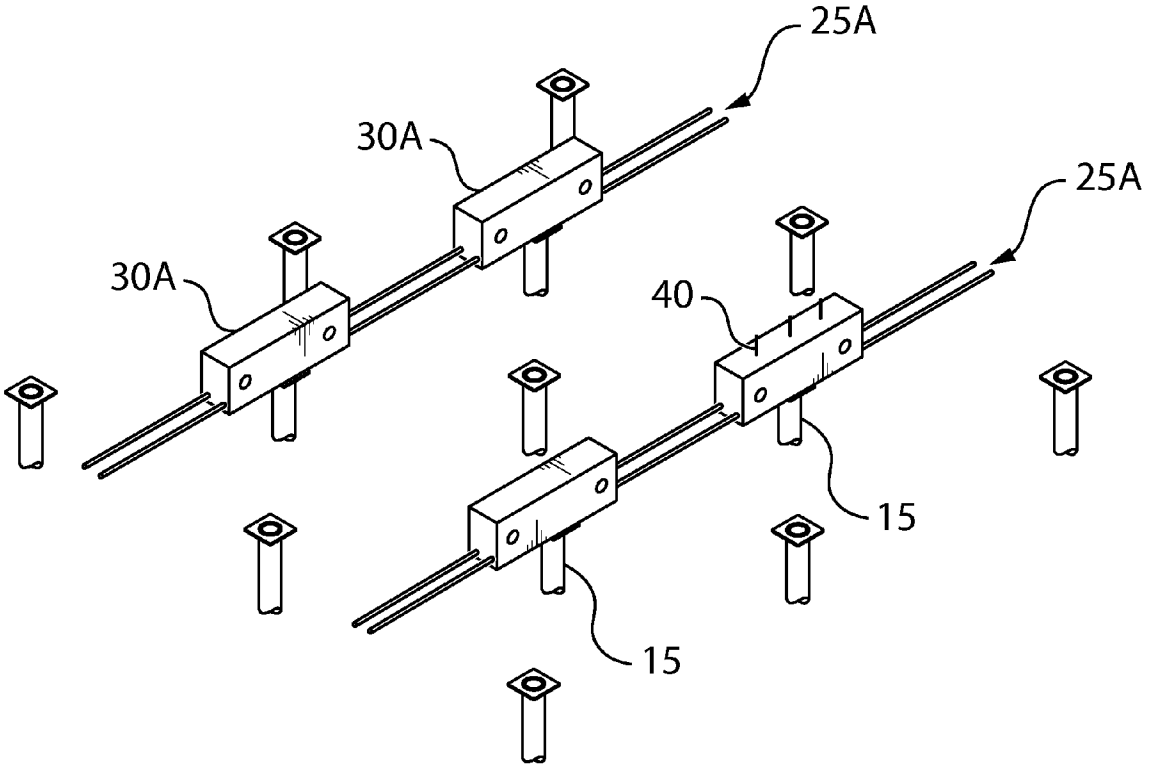
FIG. 2 shows a pair of cross-brace sections laid upon the supports of FIG. 1 according to a current embodiment.
Figure 3:
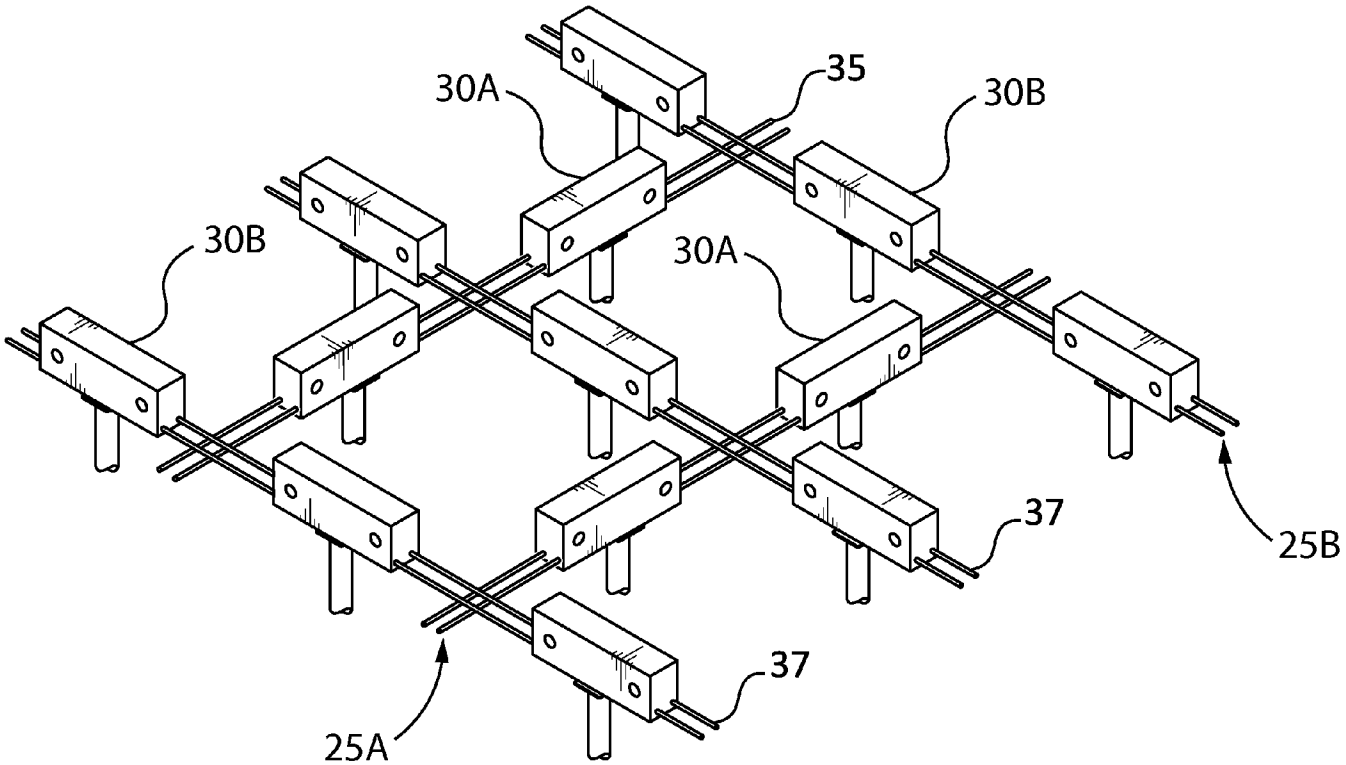
FIG. 3 shows a second pair of cross-brace sections laid perpendicularly to the cross-brace sections of FIG. 2.

Turning now to FIGS. 2 and 3, there is shown a plurality of pre-formed cross-brace segments 25A and 25B. The segments 25A are laid out to be supported on respective supports 15 in a first direction, for example running the length of a building floor. The segments 25B are laid out in a direction perpendicular to the direction of the segments 25A, such that the combination of cross-brace segments 25A and 25B form a grid for receiving pre-cast, flat concrete slabs, as will be discussed in further detail below. The cross-brace segments 25A and 25B can optionally include a plurality of support blocks 30A and 30B, respectively, connected to each other by one or more rebars 35 and 37, which run approximately the entire length of the cross-brace segment. The blocks 30A and 30B can be stock, pre-cast concrete elements, and when assembled into the cross-brace are spaced apart to accommodate the pre-cast concrete slab that will be supported by the cross-brace segments 25A and 25B. The particular size, dimensions and spacing of the blocks 30A and 30B can be selected according to the application. One optional design selection is to size the blocks 30A and 30B to be of a minimum volume capable of supporting the flat concrete slabs that will be placed thereon. Other designs are also contemplated. Creating the cross-brace from such blocks and rebars permits for a highly flexible and customizable length of cross-brace created entirely from elements that can be pre-constructed. This adds to the modularity of the system and method as herein described in that the cross-braces themselves are modular elements, which are entirely scalable. Rebars 35 and 37 are typically metal rods cut to the intended length of the cross-brace 25A, 25B, respectively, and can be positioned and fixed within the blocks 30A and 30B depending on the application.

The cross-brace segments 25A and 25B, once assembled, form a grid understructure upon which flat, pre-cast concrete elements can be placed. The rebars 35 and 37, while serving to hold and connect the distinct blocks 30A and 30B, respectively, will also assist in maintaining poured concrete (as discussed below) in tension.

The resulting structure following this step is one where a plurality of blocks 30A are connected in series by one, and optionally two, rebars 35, to form a first cross-brace segment 25A, and supported on respective supports 15. A plurality of these cross-brace segments 25A are laid out across the intended floor. Positioned perpendicular to the cross-brace segments 25A are cross-brace segments 25B, consisting of blocks 30B connected in series by one, and optionally two rebars 37. Where two rebars are used, they are optionally positioned parallel to each other, and at the same vertical height above the ground. The cross-brace segments 25B may be supported by their own respective supports 15, which can be height adjusted as described earlier to accommodate the small differential in height above the ground between the cross-brace segments 25A and the cross-brace segments 25B. In addition, or alternatively, the rebars 37 can be supported entirely or in part by the rebars 35. Optionally, one or more rivets 40 may be provided on the blocks 30A and 30B, to aid in the locating of the pre-cast cement slabs.

Figure 4:
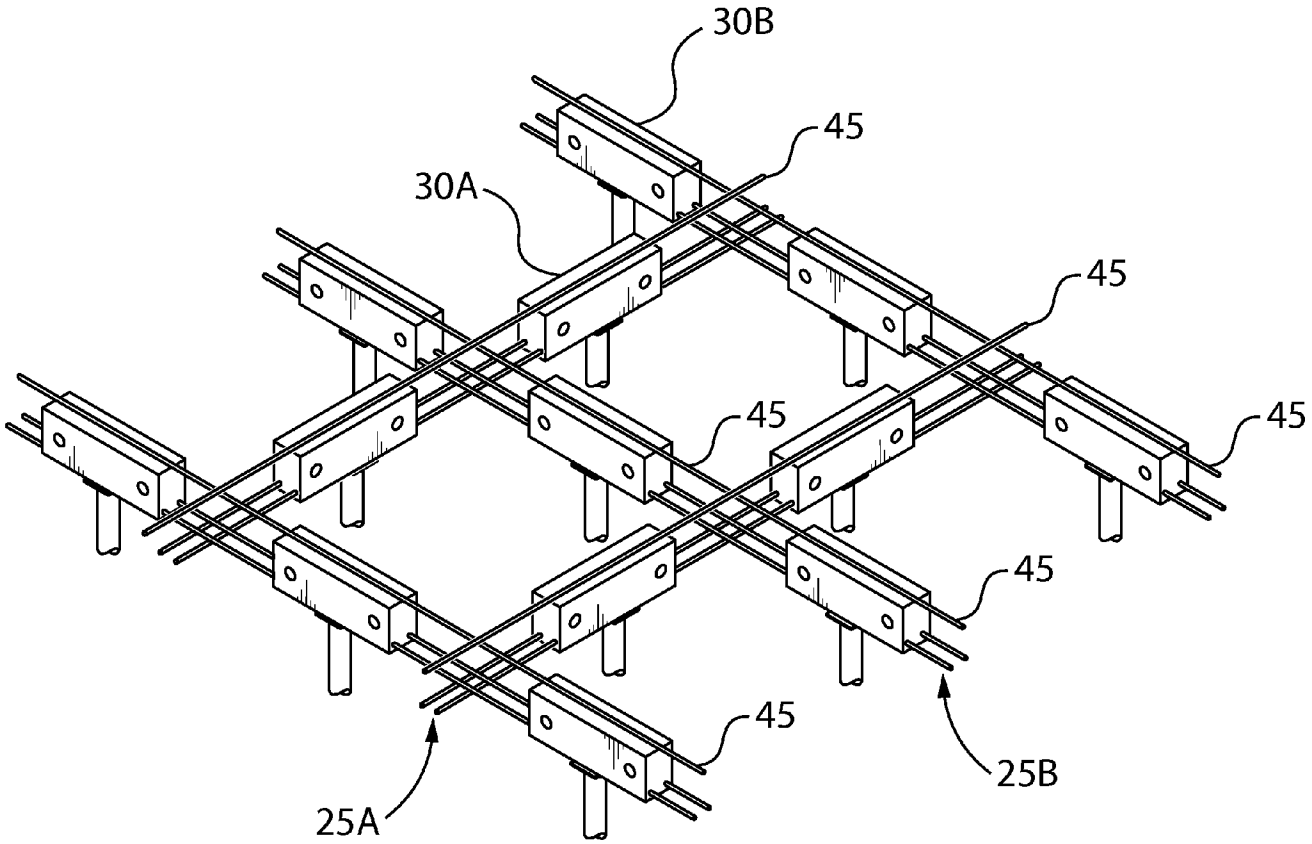
FIG. 4 shows a top rebar upon the cross-brace sections of FIG. 2 and FIG. 3.

Next, as shown in FIG. 4 a top rebar 45 is positioned along the top surface of one, or both, of the cross-brace segments 25A or 25B. The purpose and use of top rebar 45 will be described further below. Typically, top rebar 45 is attached to only one of cross-brace segment 25A or 25B, even though having another top rebar on the other of these cross-segments is certainly contemplated. Optionally, top rebar 45 may be pre-installed and positioned on the cross-brace segment(s) prior to assembly at the building site.

Figure 5:
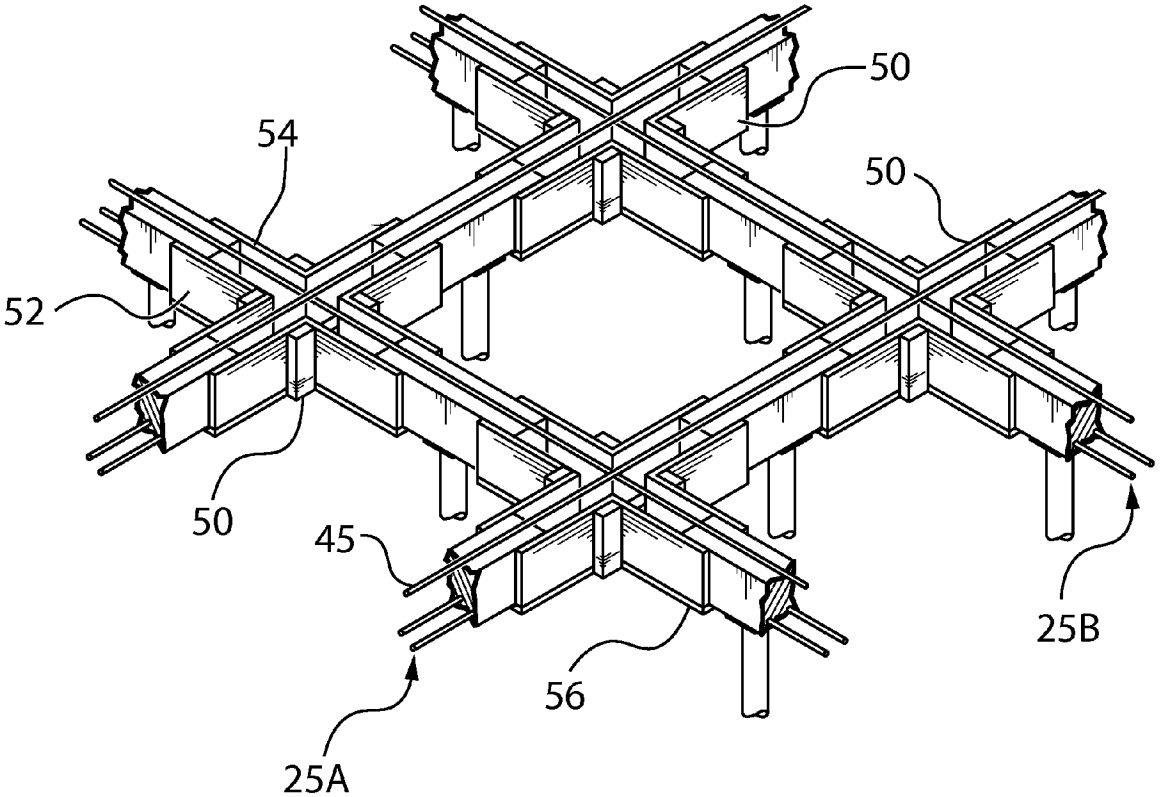
FIG. 5 shows the forming of channels around the cross-brace sections of FIGS. 2 and 3.

Turning now to FIG. 5, the grid understructure is completed by forming channels 50 around each of the blocks 30A and 30B. The channels 50 are optionally formed by attaching inner 52 and outer 54 channel wall portions to each block 30A, 30B (excluding those blocks on the periphery of the grid understructure), on opposite sides thereof, and a bottom wall portion 56 to an underside thereof. In essence, the blocks 30A and 30B form solid portions of the channels 50. The channels 50 may be formed in other ways, and from a variety of materials. In this embodiment, wood panels can be secured to the blocks 50 as edge connectors between two adjacent, and perpendicular blocks 30A and 30B, with another wood panel placed underneath to form the bottom wall portion. Other materials other than wood may also readily be used, including sheet metal. The rebars connecting each of the blocks 30A, 30B are intended to be encapsulated within the channels 50 such that when concrete is later poured into the channels 50, the rebars perform their intended function of maintaining tension within the concrete channels.

The channels 50 can be sufficiently sealed such that concrete can be poured into the channels, and sufficiently harden without significant leakage. There is no requirement, however, that the channels be water tight. Channels 50 could also be built entirely around, and underneath the blocks 30A, 30B, although this would require longer wall sections, which may be undesirable. Various hardware elements, or additional wood (or other material) supports may be employed to strengthen the channels, connect the channels to the blocks, or otherwise provide the intended function.

On the periphery of the floor, channels are analogously formed so as to complete the understructure forming a grid-pattern of channel, either encompassing the blocks 30A, 30B, or using the sides of the blocks 30A, as sides of the channel.

Figure 6:
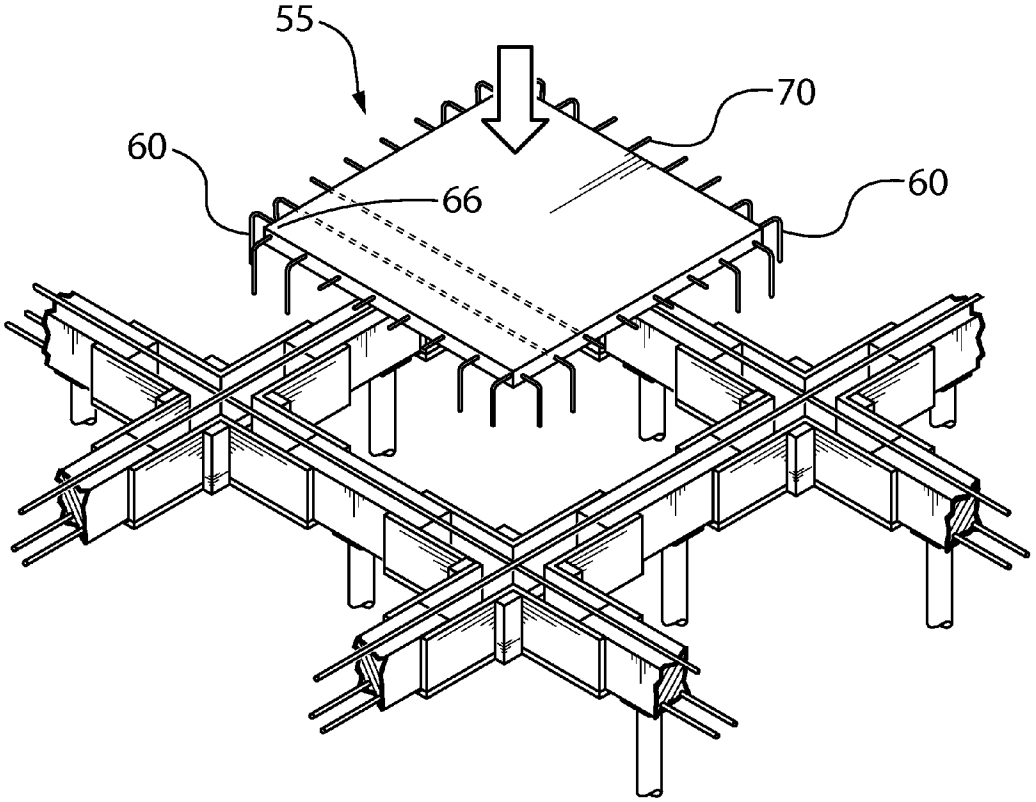
FIG. 6 shows a pre-cast concrete slab being placed atop the cross-brace sections of FIGS. 2 and 3.
Figure 7:
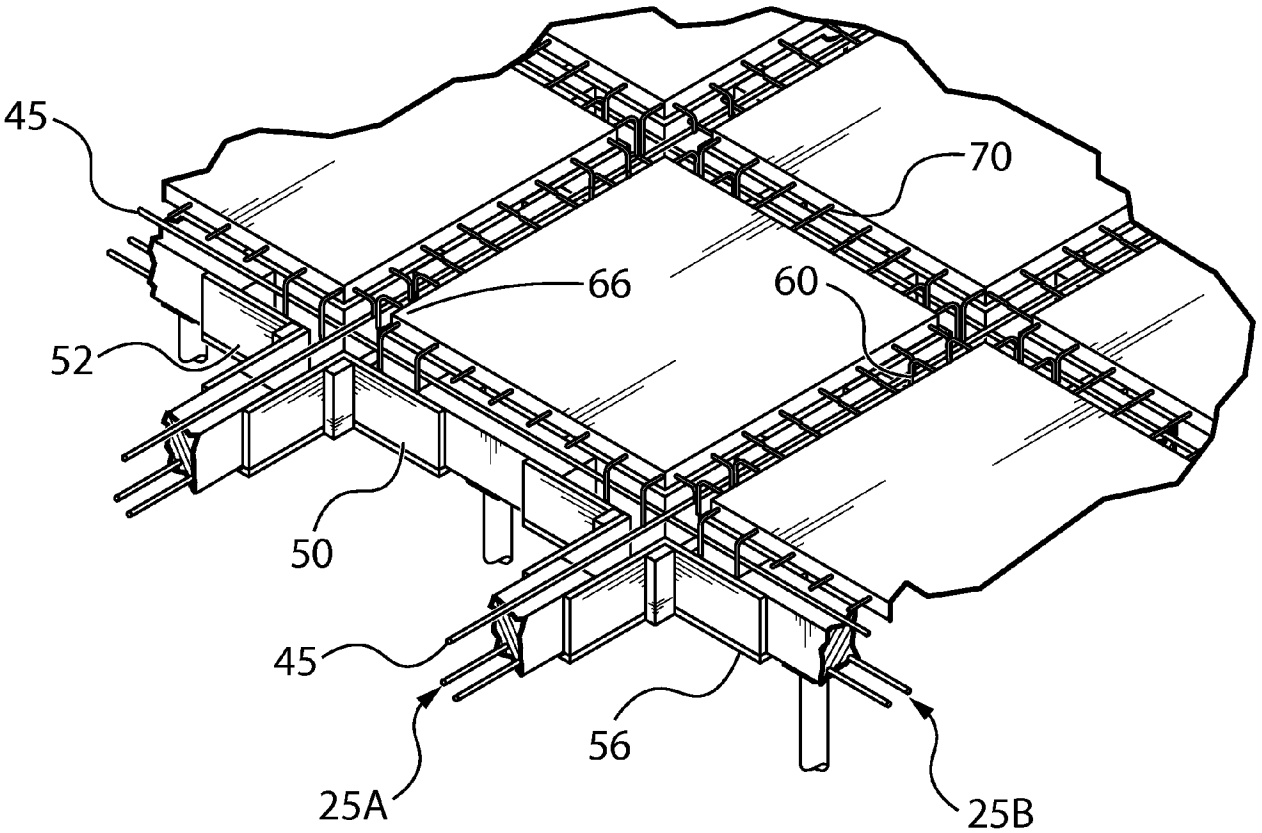
FIG. 7 shows the pre-cast concrete slab of FIG. 6 once installed atop the cross-brace sections of FIGS. 2 and 3.

Next, and as shown in FIGS. 6 and 7, pre-cast, flat concrete slabs 55 are positioned atop the grid understructure, by resting on each of the blocks 30A, 30B. In embodiments where rivets extend upwardly from the blocks 30A, 30B, corresponding locating holes are provided on the concrete slabs 55 to define the position of the concrete slabs 55. Concrete slabs 55 are typically entirely pre-cast and provide for a great deal of flexibility in the modular nature of the building structure and method as herein described.

As shown in FIG. 6, each of the concrete slabs 55 optionally include a plurality of rebars 60, 70 extending outwardly from the sides of the slab 55. In the current embodiment, a pair of corner rebars 60 are provided on adjacent sides of each corner 66 of the slab 55, and one or more main body rebars 70 between the corner rebars 60 of adjacent corners 66. The main body rebars 70 generally extend outwardly from the mid-portion of the sides of the slab 55. The corner rebars 60 extend outwardly from the sides of the slab 55 adjacent the corners 66 and curve downwardly towards the ground surface on which the building is built, forming a hook-type arrangement.

Once the slabs 55 are positioned on the blocks 30A, 30B, as per FIG. 7, the corner rebars 60 hook around the top rebar 45 positioned atop the blocks 30A, 30B. The main body rebars 70 extend over the top rebar 45.

Figure 8:
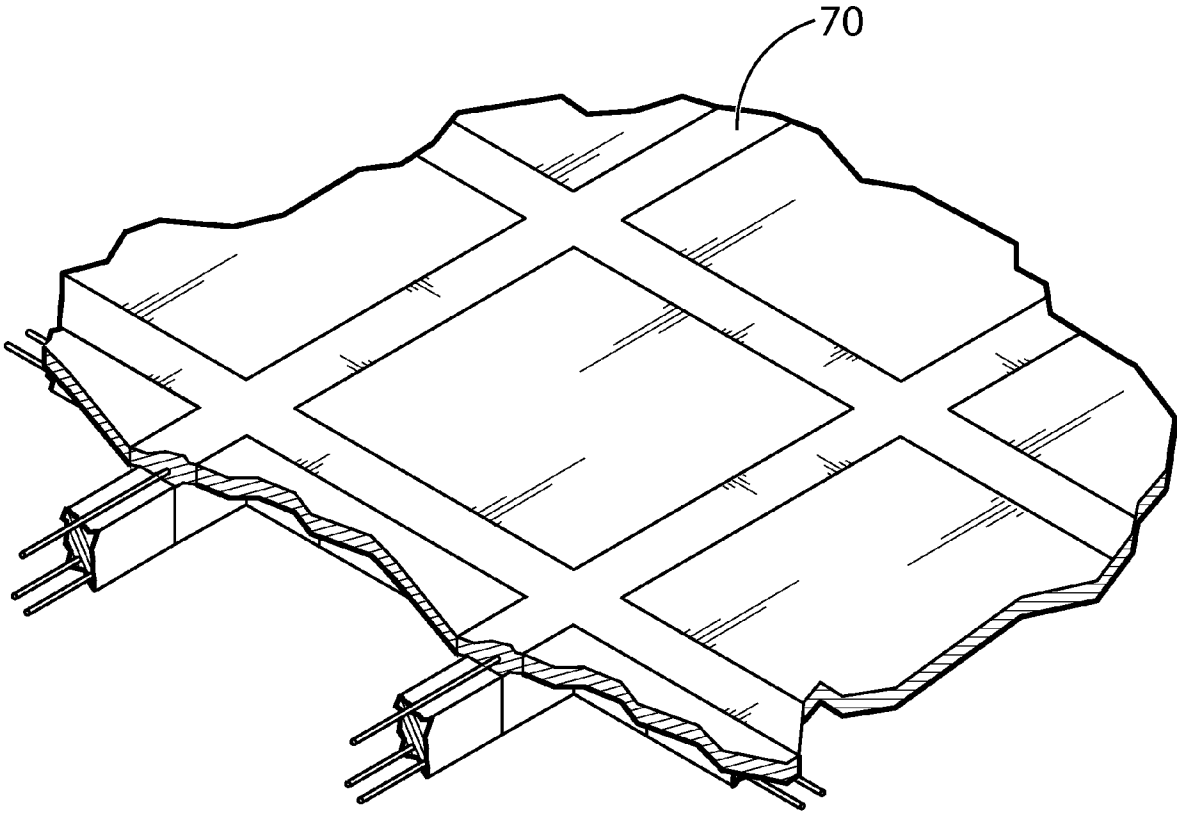
FIG. 8 shows poured concrete filling the channels of FIG. 5 and the spaces between the concrete slabs of FIG. 7.

Next, as shown in FIG. 8, concrete 70 is poured into each of the channels 50 to form a generally flat top surface, which forms the floor being constructed in the building. The poured concrete fills the channels 50, encapsulating the top rebar 45, the main body rebars 70 and the corner rebars 60. The top rebars 45 and the main body rebars 70 serve the function of maintaining tension within the concrete structure, as rebars are known to do. The corner rebars 60, being curved to hook around the top rebar 45 also aids in maintaining tension, but in addition serves the unique purpose of fixing the slab 55 in place. Without the curved corner rebars 60, under certain loading conditions, there is a risk that the slab 55 could be placed under certain forces, which in extreme conditions would lead to the slab 55 becoming dislodged by popping upwards from the concrete surrounding it. The curved rebars 60 have been found to prevent this from happening and provide an additional strengthening factor within the concrete structure. Of course, the degree to which the slab 55 could dislodge is relatively small and in practice typically results in an uneven floor, rather than catastrophic events, but the provision of the curved rebars 60 and their interaction with the top rebar 45 appears to decrease the likelihood of this condition.

Figure 9:
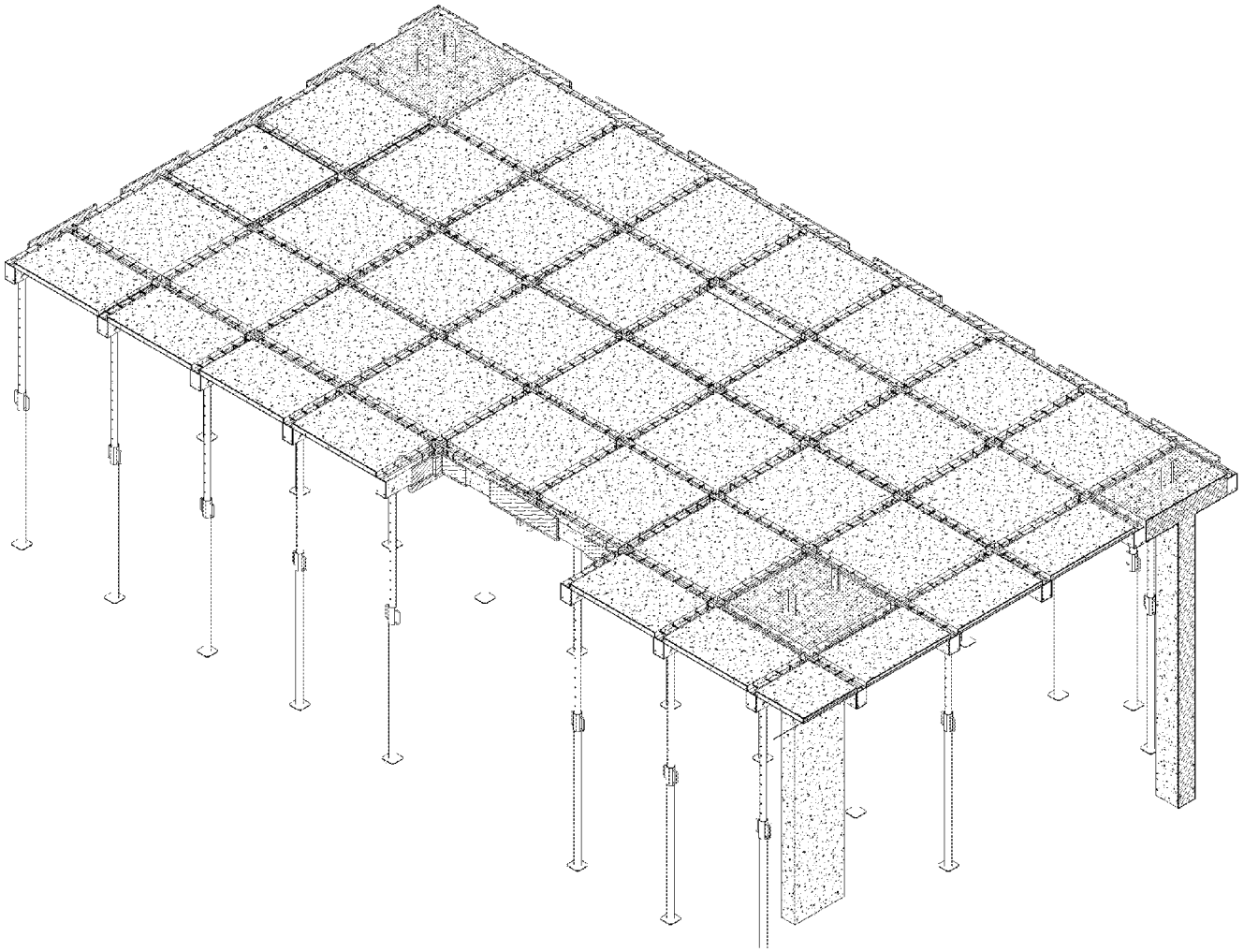
FIG. 9 shows a complete floor of the building structure, prior to the pouring of concrete.

FIG. 9 shows a generally completed floor structure prior to the pouring of concrete within the channels. Once the cement structure has been completed, the building itself can be completed by adding exterior and interior walls, as is typically done in other modular home constructions. One manner in which exterior walls can be provided is as described in U.S. Pat. No. 8,291,675 to Tikhovskiy, the contents of which are herein expressly incorporated by reference.

Various modifications and alternatives may be made to the embodiments described herein. For example, at least one of the cross-brace sections could be provided as an elongated, pre-cast concrete section with rebars running therethrough. In this variation, rather than providing the separated blocks in forming the cross-brace sections, only a single effective block is present which runs the length or width of the building floor. The perpendicular cross brace can then be provided with separated blocks as described above, thereby reducing some of the on-site work needed in completing the channels in the understructure. However, this variation can result in less modularity. Otherwise, different types of materials may be used in forming the channels of the understructure, and indeed these channels may be pre-formed such that they are merely connected to the concrete blocks on-site. For example, sheet metal corner elements could be produced in advance and simply connected on-site to complete the channels around the blocks.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

What is claimed is:

1. A concrete building structure comprising:

a first cross-brace section, including a plurality of equidistant and spaced apart, pre-cast concrete blocks connected in series by at least one rebar, extending generally a length of a floor in the building structure;

a second cross-brace section, including a plurality of equidistant and spaced apart, pre-cast concrete blocks connected in series by at least one rebar, extending generally perpendicularly to said first cross-brace section and spanning a width of the floor in the building structure, such that said first cross-brace section and said second cross-brace section form a grid understructure;

a first channel surrounding at least a portion of adjacent blocks of the first cross-brace section and a second channel surrounding at least a portion of adjacent blocks of the second cross-brace section, the adjacent blocks of the first cross-brace section oriented perpendicular to the adjacent blocks of the second cross-brace section, wherein an intersection is formed at a location where the first channel intersects the second channel, whereby said grid understructure includes the first and second channels running along a length and width of the grid understructure into which concrete may be poured at a building site, each of said plurality of blocks positioned within respective first and second channels;

a plurality of pre-cast concrete slabs resting atop said blocks in said grid understructure, wherein each of said pre-cast concrete slabs is supported by the first cross-brace section and by the second cross-brace section, said pre-cast concrete slabs spaced apart from each other such that concrete may be poured between adjacent concrete slabs; and, poured concrete filling each of said first and second channels and the space between adjacent concrete slabs to complete a generally flat floor of the building structure.

2. The concrete building structure of claim 1, wherein at least one of said first and said second cross-brace sections further includes a top rebar extending along a length of a top surface thereof.

3. The concrete building structure of claim 2, wherein said top rebar is attached to a top surface of each of said blocks within at least one of said first and second cross-brace sections.

4. The concrete building structure of claim 3, wherein each of said pre-cast concrete slabs include at least one main body rebar extending through the concrete slab and extending outwardly from opposite sides of said concrete slab in a direction parallel to a top surface of said slab.

5. The concrete building structure of claim 4, wherein each of said pre-cast concrete slabs further includes at least one corner rebar extending outwardly from a side of said concrete slab, proximate a corner of the slab, wherein said at least one corner rebar extends outwardly in a direction parallel to the top surface of the slab and then downwardly in a direction perpendicular to the top surface of the slab.

6. The concrete building structure of claim 5, wherein said at least one corner rebar hooks around said top rebar.

7. The concrete building structure of claim 1, wherein each of said first and second channels comprise panels attached to sides of adjacent blocks from each of said first and second cross-brace sections, and a bottom panel attached to the bottom of each of said blocks.

8. The concrete building structure according to claim 1, wherein said blocks further comprise at least one rivet extending upwardly away from a top surface of said blocks, and wherein said pre-cast concrete slabs comprise locating holes corresponding with said at least one rivet.

9. The concrete building structure of claim 1 comprising two or more floors, each floor having said grid understructure, said first and second channels and said plurality of pre-cast concrete slabs.

10. A method for constructing a concrete building structure comprising:

arranging a plurality of supports in a grid-like arrangement, said supports generally defining a ceiling height in a floor of the building structure;

placing a plurality of first cross-brace sections on said supports, said first cross-brace sections including a plurality of equidistant and spaced apart, pre-cast concrete blocks connected in series by at least one rebar, wherein one support is provided for each concrete block such that each concrete block rests on its respective support;

placing a plurality of second cross-brace sections perpendicular to said first cross-brace sections such that said first and second cross-brace sections form a gird understructure spanning a floor of the concrete structure, said second cross-brace sections including a plurality of equidistant and spaced apart, pre-cast concrete blocks connected in series by at least one rebar;

forming a first channel surrounding at least a portion of adjacent blocks of the first cross-brace section and a second channel surrounding at least a portion of adjacent blocks of the second cross-brace section, the adjacent blocks of the first cross-brace section oriented perpendicular to the adjacent blocks of the second cross-brace section, such that said grid understructure includes said first and second channels running along a length and width of the grid understructure; and positioning a plurality of pre-cast concrete slabs atop said blocks in said grid understructure, wherein each of said pre-cast concrete slabs is supported by the first cross-brace section and the second cross-brace section, said pre-cast concrete slabs spaced apart from each other such that concrete may be poured between adjacent concrete slabs;

pouring concrete into each of said first and second channels and into the space between adjacent concrete slabs to complete a generally flat floor of the building structure.

11. The method of claim 10, wherein at least one of said first and said second cross-brace sections further includes a top rebar extending along a length of a top surface thereof.

12. The method of claim 11, wherein said top rebar is attached to a top surface of each of said blocks within at least one of said first and second cross-brace sections.

13. The method of claim 12, wherein each of said pre-cast concrete slabs include at least one main body rebar extending through the concrete slab and extending outwardly from opposite sides of said concrete slab in a direction parallel to a top surface of said slab.

14. The method of claim 13, wherein each of said pre-cast concrete slabs further includes at least one corner rebar extending outwardly from a side of said concrete slab, proximate a corner of the slab, wherein said at least one corner rebar extends outwardly in a direction parallel to the top surface of the slab and then downwardly in a direction perpendicular to the top surface of the slab.

15. The method of claim 14, wherein said at least one corner rebar hooks around said top rebar.

16. The method of claim 10, wherein said first and second channels comprise panels attached to sides of adjacent blocks from each of said first and second cross-brace sections, and a bottom panel attached to the bottom of each of said blocks.

17. The method of claim 10, wherein said blocks further comprise at least one rivet extending upwardly away from a top surface of said blocks, and wherein said pre-cast concrete slabs comprise locating holes corresponding with said at least one rivet.

* * * * *